US005659734A

United States Patent [19]

Tsuruta et al.

[11] Patent Number: 5,659,734

[45] Date of Patent: Aug. 19, 1997

[54] COOPERATION SCHEME FOR PLURAL WORK STATIONS

[75] Inventors: Setsuo Tsuruta, Machida; Kiyomi Kishi, Kawasaki; Kuniaki Matsumoto, Tokyo, all of Japan

[73] Assignees: Hitachi, Ltd., Tokyo; Hitachi Information and Control Systems, Inc., Hitachi, both of Japan

[21] Appl. No.: 594,946

[22] Filed: Oct. 10, 1990

[30] Foreign Application Priority Data

Oct. 13, 1989 [JP] Japan ..... 1-264942

[51] Int. Cl.[6] ..... G06F 7/00; G06F 17/30

[52] U.S. Cl. ..... 395/608; 395/200.31; 395/201; 395/208

[58] Field of Search ..... 364/401, 468, 364/402; 395/200, 600, 325, 200.03

[56] References Cited

U.S. PATENT DOCUMENTS

| | | | |
|---|---|---|---|
| 4,122,523 | 10/1978 | Morse et al. | 364/436 |
| 4,186,438 | 1/1980 | Benson et al. . | |
| 4,648,036 | 3/1987 | Gallant . | |
| 4,714,995 | 12/1987 | Materna et al. . | |
| 4,718,002 | 1/1988 | Carr | 364/DIG. 1 |
| 4,751,635 | 6/1988 | Kret | 395/600 |
| 4,827,423 | 5/1989 | Beasley et al. | 364/468 |
| 4,868,866 | 9/1989 | Williams, Jr. | 380/49 |
| 4,926,343 | 5/1990 | Tsuruta et al. | 364/136 |
| 4,939,668 | 7/1990 | Brown et al. | 364/200 |
| 4,949,254 | 8/1990 | Shorter | 395/700 |
| 5,008,853 | 4/1991 | Bly et al. | 395/153 |
| 5,040,142 | 8/1991 | Mori et al. | 364/900 |
| 5,077,666 | 12/1991 | Brimm et al. | 364/413.02 |
| 5,122,959 | 6/1992 | Nathanson et al. | 364/436 |
| 5,140,685 | 8/1992 | Sipple et al. | 395/425 |
| 5,170,480 | 12/1992 | Mohan et al. | 395/600 |
| 5,193,162 | 3/1993 | Bordsen et al. | 395/425 |
| 5,202,984 | 4/1993 | Kashio | 395/600 |
| 5,212,789 | 5/1993 | Rago | 395/600 |
| 5,261,069 | 11/1993 | Wilkinson et al. | 395/425 |
| 5,270,073 | 12/1993 | Gausman et al. | 395/600 |
| 5,278,984 | 1/1994 | Babchelor | 395/656 |
| 5,459,862 | 10/1995 | Garliepp et al. | 395/600 |

FOREIGN PATENT DOCUMENTS

| | | |
|---|---|---|
| 2925169 | 1/1981 | Germany . |
| 59-763 | 1/1984 | Japan . |
| 59-33953 | 2/1984 | Japan . |
| 61-177502 | 8/1986 | Japan . |
| 62-1070 | 1/1987 | Japan . |

OTHER PUBLICATIONS

"Int Conference on Railways in the electronic age" Nov. 1981 London pp. 207–2123 G. Boccassi.

IEEE Engineering in microbiology and biology 10 Ann. Int. Conf. vol. 10 p. 3 Nov. 1988 pp. 1446–1447.

Everest, G., *Database Management*, copyright 1986, chapters 13 & 18, pp. 454–550 & 732–781.

Martin, J., *Design and Strategy for Distributed Data Processing*, copyright 1984, chapter 19, pp. 272–286.

*Primary Examiner*—Gail O. Hayes

*Assistant Examiner*—Krishna V. Kalidindi

*Attorney, Agent, or Firm*—Antonelli, Terry, Stout & Kraus, LLP

[57] ABSTRACT

On knowledge information processing and especially in a plan making system such as a system for generating schedule diagrams of trains and personnel, it becomes necessary to make or modify a plan by using a plurality of work stations when the plan becomes large-sized. At this time, the work stations are provided with equal plan making function. Thus, the work stations can divide planning responsibilities. Further, work stations are provided with priorities. Thus, management of competition among a plurality of work stations is facilitated and overhead caused by communication among a plurality of devices is reduced.

20 Claims, 10 Drawing Sheets

COOPERATION SCHEME FOR PLURAL WORK STATIONS

BACKGROUND OF THE INVENTION

The present invention relates to making a plan such as train schedule diagram and personnel arrangement schedule.

In a plan making system for solving a complicated problem such as generation of train schedule diagram or personnel arrangement schedule, fine man-machine controllability is important. If a problem becomes complicated and large-sized, however, its processing using a single work station as in the conventional technique becomes impossible. Therefore, planning using a plurality of work stations becomes necessary. Since the number of operations conducted by operators is large when planning, it is necessary that operation management among a plurality of work stations be performed rapidly.

In conventional master-slave type dual systems, the output of the subsidiary system (slave) is not reflected onto the system in the normal state. Thus, the output of the subsidiary system is not reflected onto the system until switching from the main system (master) to the subsidiary system is performed in case of failure of the main system.

When the scale of the plan becomes large, it becomes impossible to display the whole plan on one screen to make and modify the plan. Therefore, it becomes necessary to divide the plan to make it. Therefore, it becomes necessary that plans of allotted ranges can be simultaneously made at a plurality of work stations. In addition, management of mutual operations becomes necessary in case plan making is to be performed at a plurality of work stations. In the above described prior art, however, the output of the subsidiary system is not reflected onto the main system, and hence a plan cannot be mutually made between both systems at the same time. Since planning is not performed at the same time, management of mutual operation conflicts between the main system and the subsidiary system has not been performed. Further, in case portions of planning are allotted to a plurality of work stations belonging to the main system or the subsidiary system, priority relations do not exist among those work stations. In operation conflict management at the time of data access, therefore, mutual monitoring is always necessary and constant overhead is always applied at the time of operation. Further, in case a plurality of operators jointly make or modify the same plan, conflicts in opinion among the respective operators may often result in a problem.

SUMMARY OF THE INVENTION

An object of the present invention is to readily allow a plurality of work stations or terminal equipment, hereinafter described with the work station only to take partial charge of planning, facilitate the management of operation conflicts a plurality of work stations, and make it possible to make or modify a plan having small overhead at the time of operation and having no contradiction.

The above described object is achieved by providing a plurality of work stations with equal plan making function, providing one of a plurality of work stations having the planning function with priority status, giving each work station partial planning responsibility, reflecting unconditionally operation applied to a work station having priority status by an operator onto work stations having no priority status, storing operation conducted at the priority work station by an operator, judging whether operation conducted at a work station having no priority status by an operator conflicts with operations conducted at the priority work station by an operator which are not yet transmitted to work stations having no priority, and making only operations which do not conflict effective.

In the cooperation scheme of a plurality of work stations, the plurality of work stations take partial planning responsibility. Even for a large-sized plan, it becomes possible to make a plan without being restricted by the screen size. Further, since respective work stations have equal planning function, division of mutual planning responsibility can be easily changed. Further, since there are priority relations among work stations, operation conflict management becomes easy by giving preference to operation of the work station having priority status when competition among operations conducted by a plurality of operators has occurred. As a result, the overhead caused at the time of operation by operation conflict management can be made small. Further, even when conflict in opinion among a plurality of operators occurs, it becomes possible to prevent occurrence of contradiction by giving preference to the operation of the work station having priority. In addition, since operation conducted at the work station is stored, operation conducted at a work station having no priority can also be easily reflected onto the work station having priority by checking with the operation of the work station having priority thus stored.

DESCRIPTION OF THE PREFERRED EMBODIMENTS

An embodiment of train schedule diagram generation according to the present invention will hereafter be described by referring to drawings.

Figure 1:
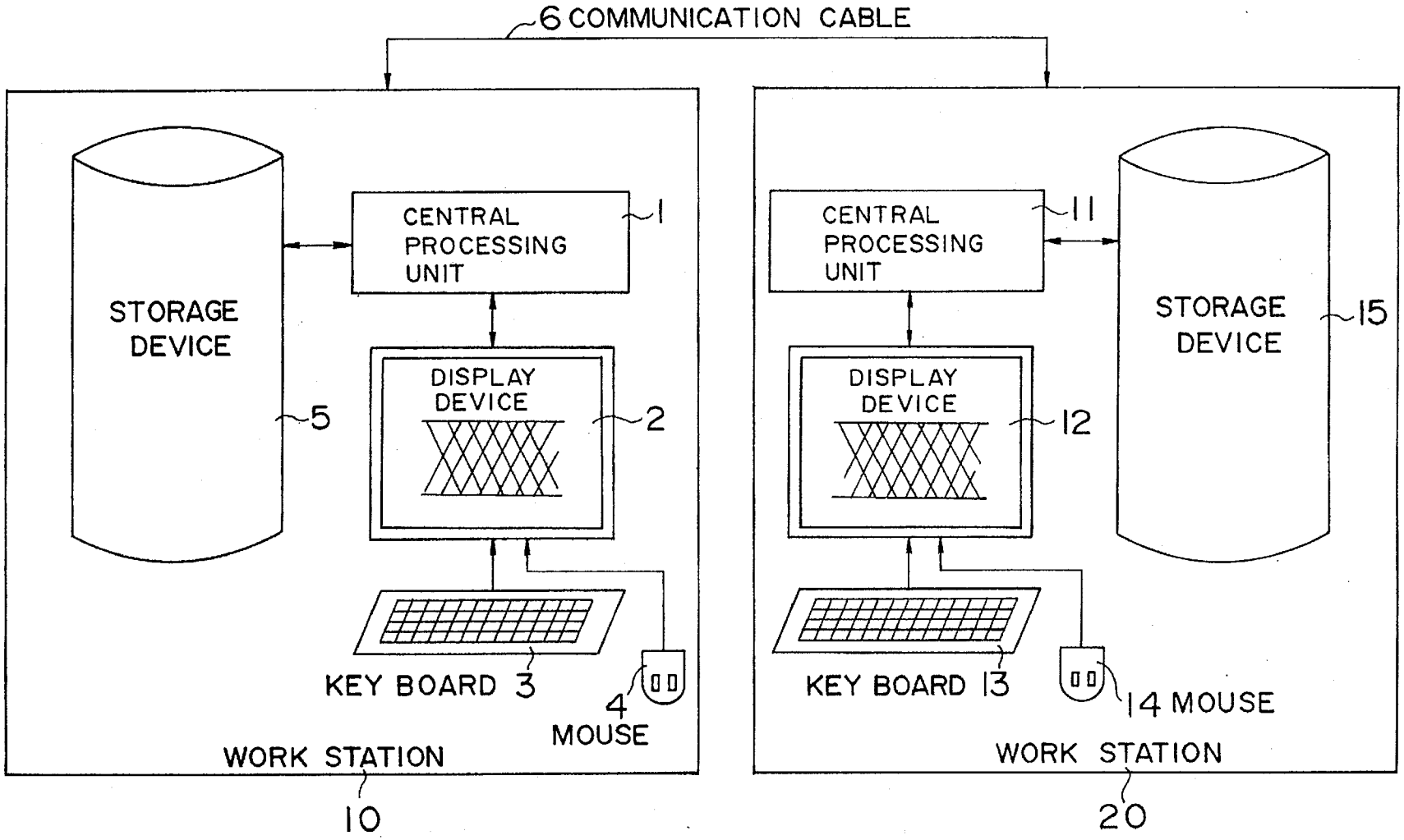
FIG. 1 is a general configuration diagram showing a cooperation scheme of a plurality of work stations according to the present invention.

FIG. 1 is a general configuration diagram of a system according to the present invention. It is now assumed in the following description that a train schedule diagram is to be generated by using two work stations.

Figure 2:
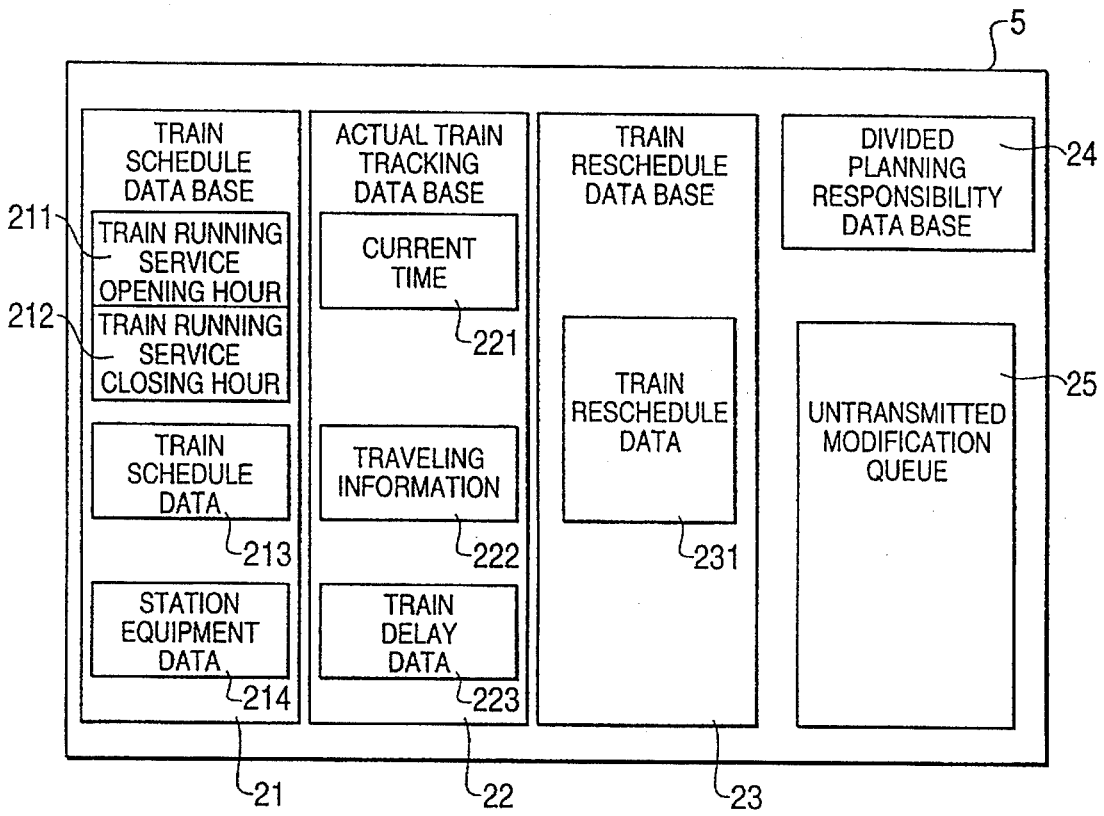
FIG. 2 is a data configuration diagram of a work station having priority according to the present invention.
Figure 3:
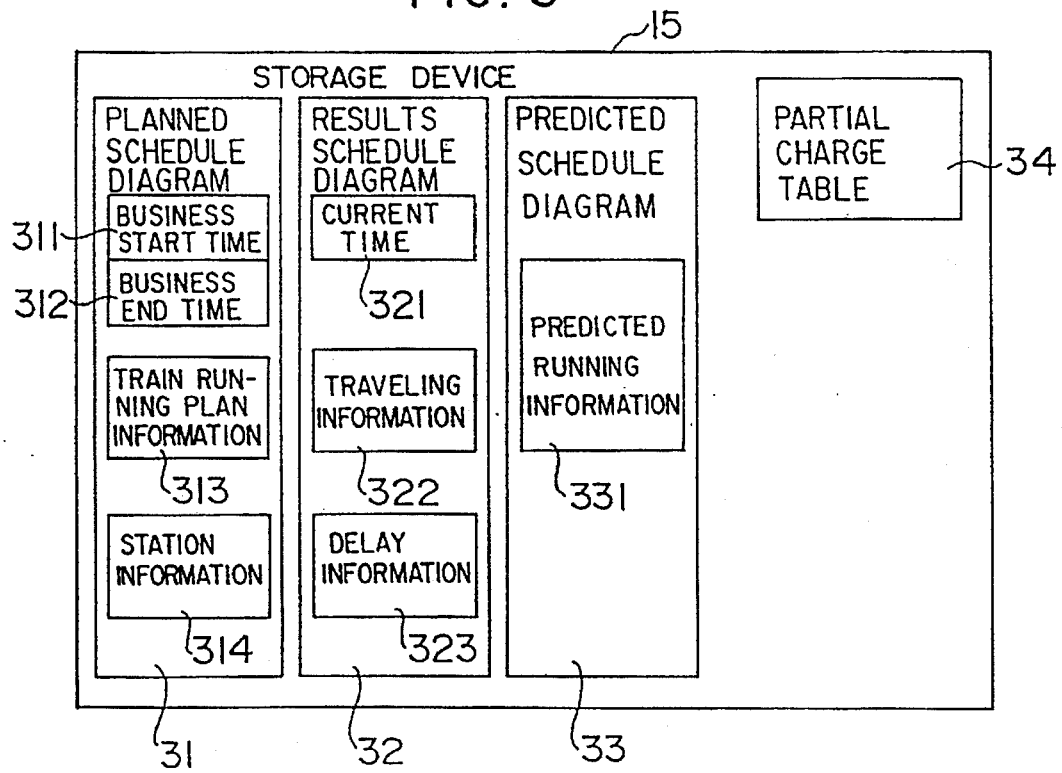
FIG. 3 is a data configuration diagram of a work station having no priority according to the present invention.

Numerals 10 and 20 denote work stations for giving instructions to generate a train schedule diagram, 1 a central processing unit of the work station 10, and 2 a display device for displaying the status of schedule diagram generation in the work station 10. Numerals 3 and 4 respectively denote a keyboard and a mouse for inputting instructions of an operator at the work station 10 when a schedule diagram is to be generated. Numeral 5 denotes a storage device for storing the current status of schedule diagram generation and schedule diagram data of the work station 10. Details of contents stored in the storage device 5 are shown in FIG. 2. Further, numeral 11 denotes a central processing unit of the work station 20, and numeral 12 denotes a display device for displaying the status of schedule diagram generation in the work station 20. Numerals 13 and 14 respectively denote a keyboard and a mouse for inputting instructions of an operator at the work station 20 when a schedule diagram is to be generated. Numeral 15 denotes a storage device for storing the current status of schedule diagram generation and schedule diagram data of the work station 20. Details of contents stored in the storage device 15 are shown in FIG. 3. Numeral 6 denotes a communication cable for connecting two work stations 10 and 20 together.

Figure 5:
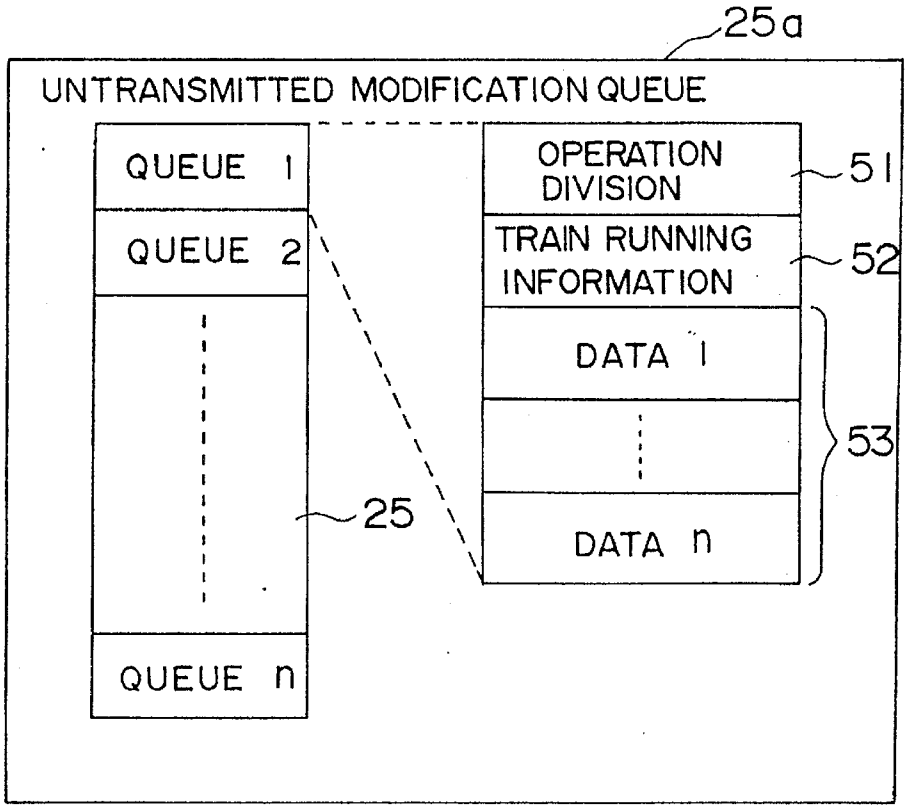
FIG. 5 shows contents of a untransmitted modification queue according to the present invention.
Figure 4:
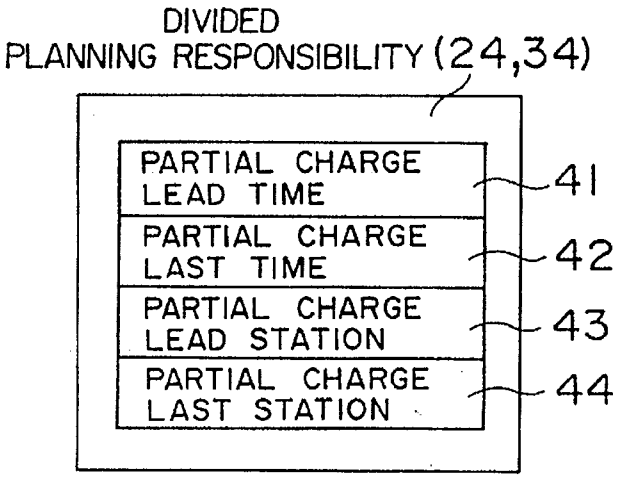
FIG. 4 shows contents of a divided planning responsibility table.
Figure 7:
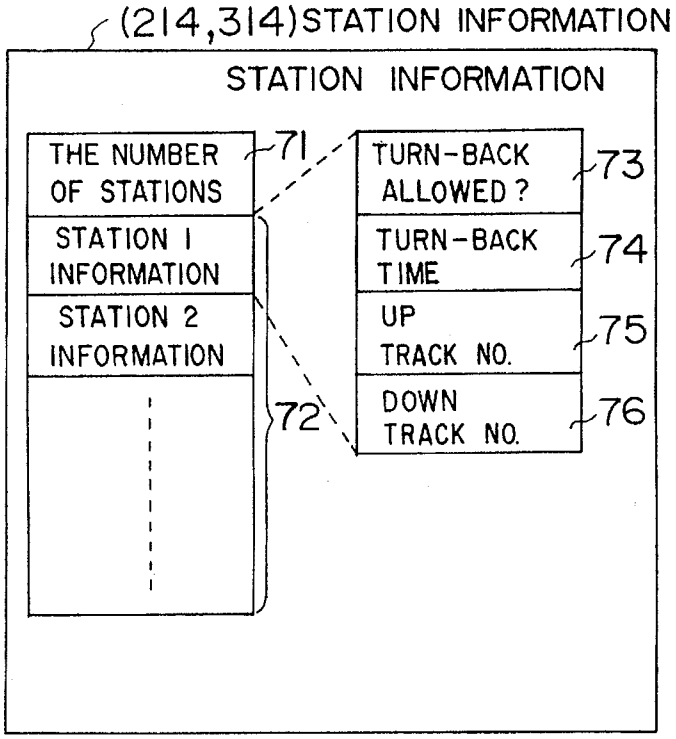
FIG. 7 shows contents of station information according to the present invention.
Figure 9:
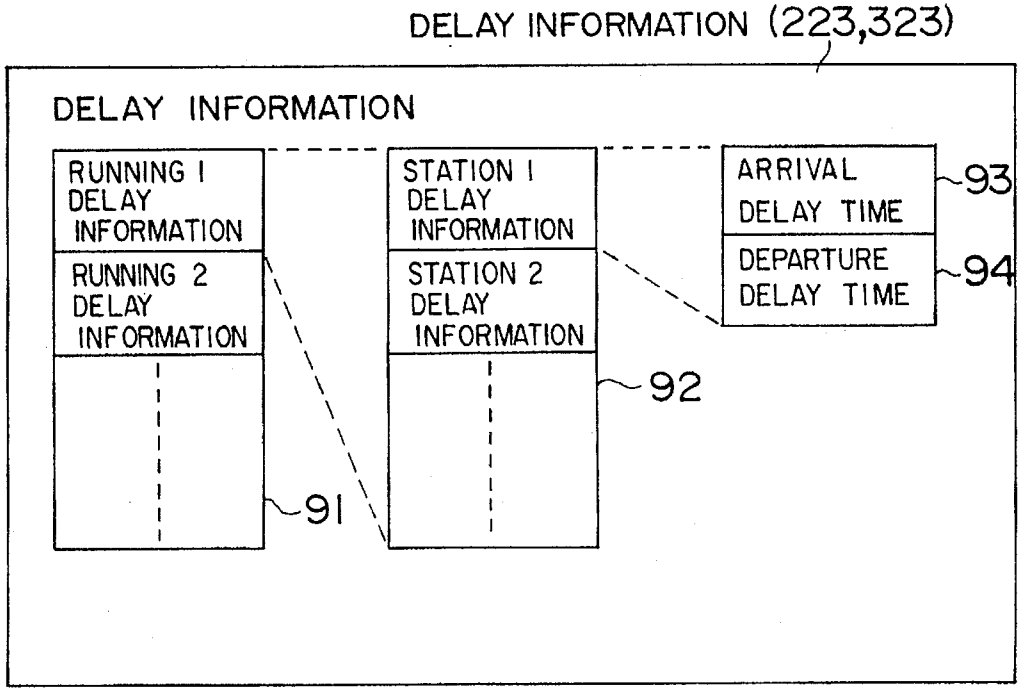
FIG. 9 shows contents of delay information according to the present invention.
Figure 8:
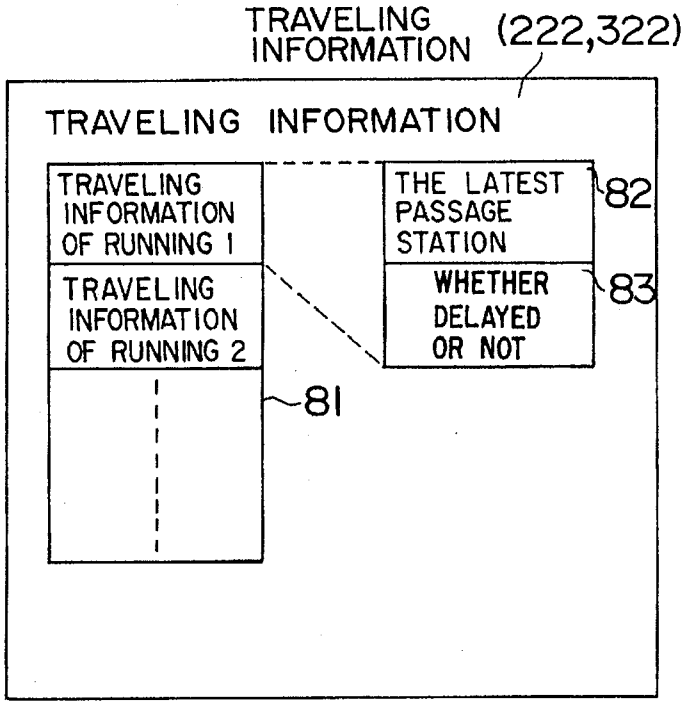
FIG. 8 shows contents of traveling information according to the present invention.
Figure 10:
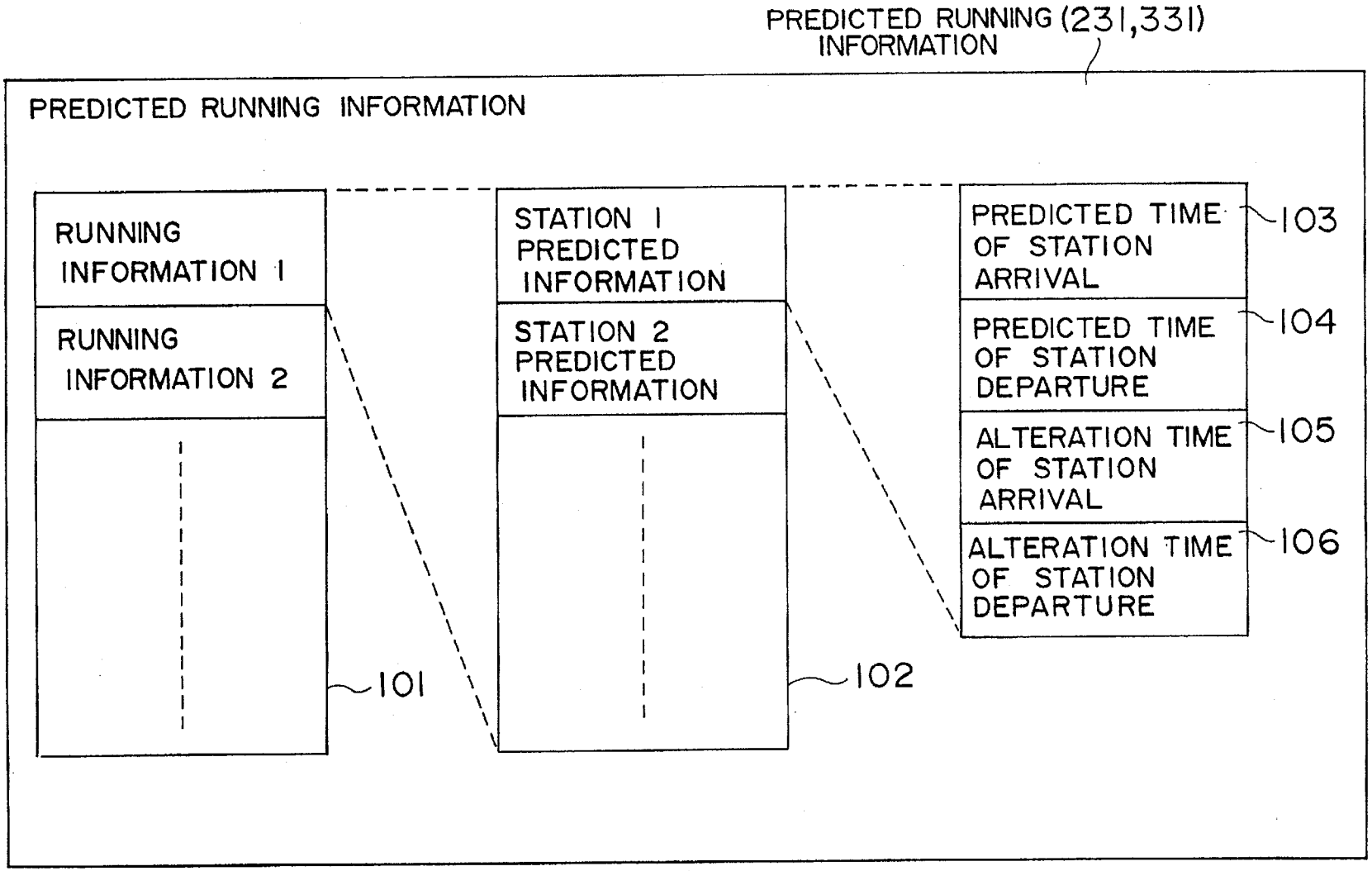
FIG. 10 shows contents of predicted running information.

FIG. 2 shows the contents of data stored in the storage device 5. Numeral 21 denotes a train schedule database table for storing a schedule diagram planned beforehand. Numerals 211 to 214 denote contents of data stored in the train schedule database 21. Numeral 211 denotes train running service opening hour of trains, 212 train running service closing hour, and 213 train schedule data. Details of the schedule data are shown in FIG. 4. Numeral 214 denotes station equipment data for storing station information required for train schedule database generation. Details of the station equipment data are shown in FIG. 7. Numeral 22 denotes an actual train tracking database table for storing tracking results of a train actually running. Numerals 221 to 223 denote data stored in the actual train tracking database 22. Numeral 221 denotes current time indicating the results data sampling execution time. Numeral 222 denotes actual train tracking data for storing the current traveling situation of trains. Details of the traveling information are shown in FIG. 8. Numeral 223 denotes train delay data for storing the delay situation of trains. Details of this delay data are shown in FIG. 9. Numeral 23 denotes a train rescheduled database table for storing the train schedule database 21 modified at the work station 10 on the basis of the actual train tracking database 22. Numeral 231 denotes data stored in the train reschedule database 23 and denotes train reschedule data for storing the status of modification of train scheduling information. Details of the train reschedule database are shown in FIG. 10. Numeral 24 denotes a divided planning responsibility database for storing the partial charge range of the work station 10. Details of this divided planning responsibility database are shown in FIG. 4. Numeral 25 denotes untransmitted update request queuing area for storing contents of schedule diagram modification performed at the work station 10 which are not transmitted to the work station 20 yet into a transmission area 25*a*. Details of the untransmitted update request queuing area are shown in FIG. 5. This untransmitted update request queuing area is a first-in first-out table.

Figure 6:
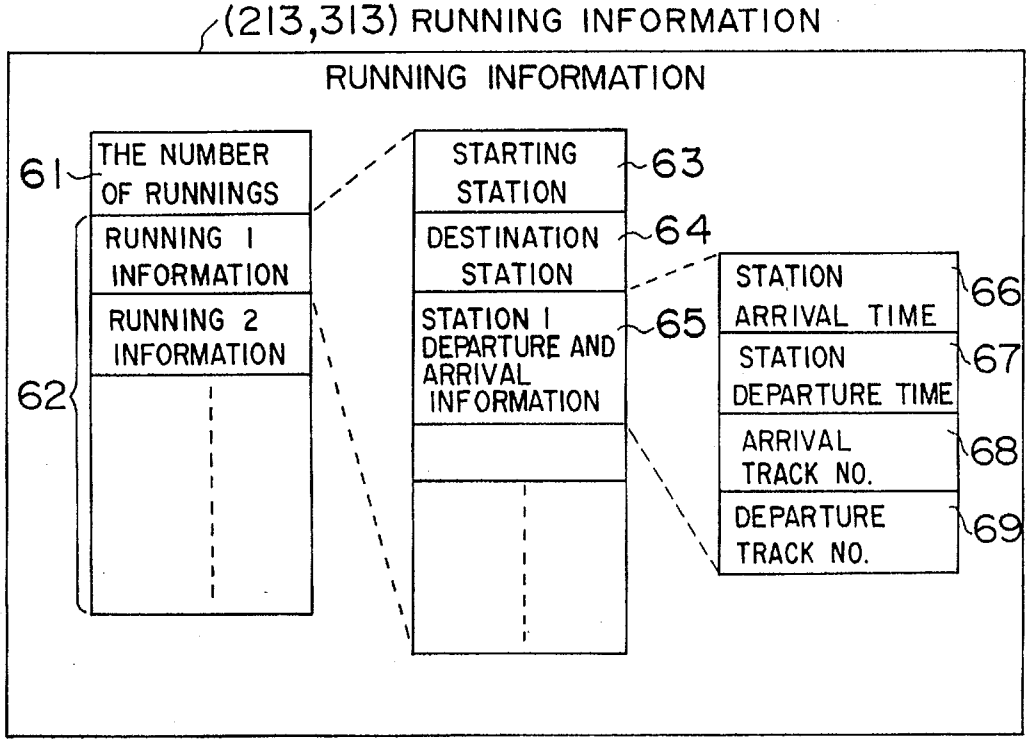
FIG. 6 shows contents of running information according to the present invention.

FIG. 3 shows contents of data stored in the storage device 15. Numeral 31 denotes a planned schedule diagram table for storing a schedule diagram planned beforehand. Numerals 311 to 314 denote contents of data stored in the planned schedule diagram table 31. Numeral 311 denotes business start time of trains, 312 business end time, and 313 running plan information of trains. Details of the train running plan information are shown in FIG. 6. Numeral 314 denotes station information for storing station information required for train schedule diagram generation. Details of the station information are shown in FIG. 7. Numeral 32 denotes a results schedule diagram table. Numerals 321 to 323 denote data stored in the results schedule diagram table 32. Numeral 321 indicates current time indicating the results data sampling execution time. Numeral 322 denotes traveling information for storing the current traveling situation of trains. Details of the traveling information are shown in FIG. 8. Numeral 323 denotes delay information for storing the delay situation of trains. Details of this delay information are shown in FIG. 9. Numeral 33 denotes a predicted schedule diagram table for storing the planned schedule diagram 31 modified at the work station 20 on the basis of the results schedule diagram 32. Numeral 331 denotes data stored in the predicted schedule diagram table 33 and indicates predicted running information for storing the situation of modification of train running plan information. Details of the predicted running information are shown in FIG. 10. Numeral 34 denotes a partial charge table for storing the partial charge range of the work station 20. Details of this partial charge table are shown in FIG. 4. The planned schedule diagram table 31 and train schedule database 21 have virtually the same contents. The results schedule diagram table 32 and actual train tracking database 22 have virtually the same contents.

FIG. 4 shows contents of the partial charge table 34 and divided planning responsibility database 24. The contents comprise beginning of allotted time range 41, end of allotted time range 42, beginning of allotted station range 43 and end of allotted station range 44. These contents represent information of ranges of routes that respective work stations 10 and 20 take partial charge.

FIG. 5 shows contents of the untransmitted update request queuing area 25 in the work station 10. Numeral 51 denotes an update operation name, 52 update train name of trains to be operated, and 53 to 55 data required when operation is executed.

FIG. 6 shows contents of the schedule data 213 and 313. Numeral 61 denotes an area for storing the number of running trains, 62 an area for storing information of each running train, 63 an area for storing the starting station of each running train, 64 an area for storing the destination station of each running train, 65 an area for storing departure and arrival information at each station, 66 an area for storing station arrival time at each station, 67 an area for storing station departure time, 68 an area for storing track number for arrival, and 69 an area for storing track number for departure.

FIG. 7 shows contents of station equipment data 214 and 314. Among them, numeral 71 denotes an area for storing the number of stations, 72 an area for storing the equipment data of each station, 73 an area for storing data pertaining to whether trains can turn back from the pertinent station or not, 74 an area for storing the minimum time required for such a turn-back operation, 75 an area for storing the track number at which up trains stop, 76 an area for storing the track number at which down trains stop.

FIG. 8 shows contents of the actual train tracking data 222 and 322. Among them, numeral 81 denotes an area for storing the traveling status of each running train, and numeral 82 denotes an area for storing a station passed by the train at time closest to the actual train running sampling time, which is also stored in the current time 221 shown in FIG. 2. Numeral 83 denotes an area for storing information pertaining to whether a delay from each schedule is present or not.

FIG. 9 shows contents of the train delay data 223 and 323. Among them, numeral 91 denotes an area for storing the delay status of each running train, 92 an area for storing delay status of the pertinent running train at respective stations, 93 an area for storing the time delay caused when a delayed train has arrived at the pertinent station, and 94 an area for storing the time delay caused when a delayed train has departed from the pertinent station.

FIG. 10 shows contents of the train reschedule data 231. Among them, numeral 101 denotes an area for storing rescheduling data of each running train after rescheduling, 102 an area for storing rescheduled data of the pertinent running train at respective stations, 103 an area for storing station arrival time based upon updated schedule data, 104 an area for storing station departure time based upon updated schedule data from the pertinent station, 105 an area for storing rescheduled station arrival time, and 106 an area for storing rescheduled station departure time.

Figure 11:
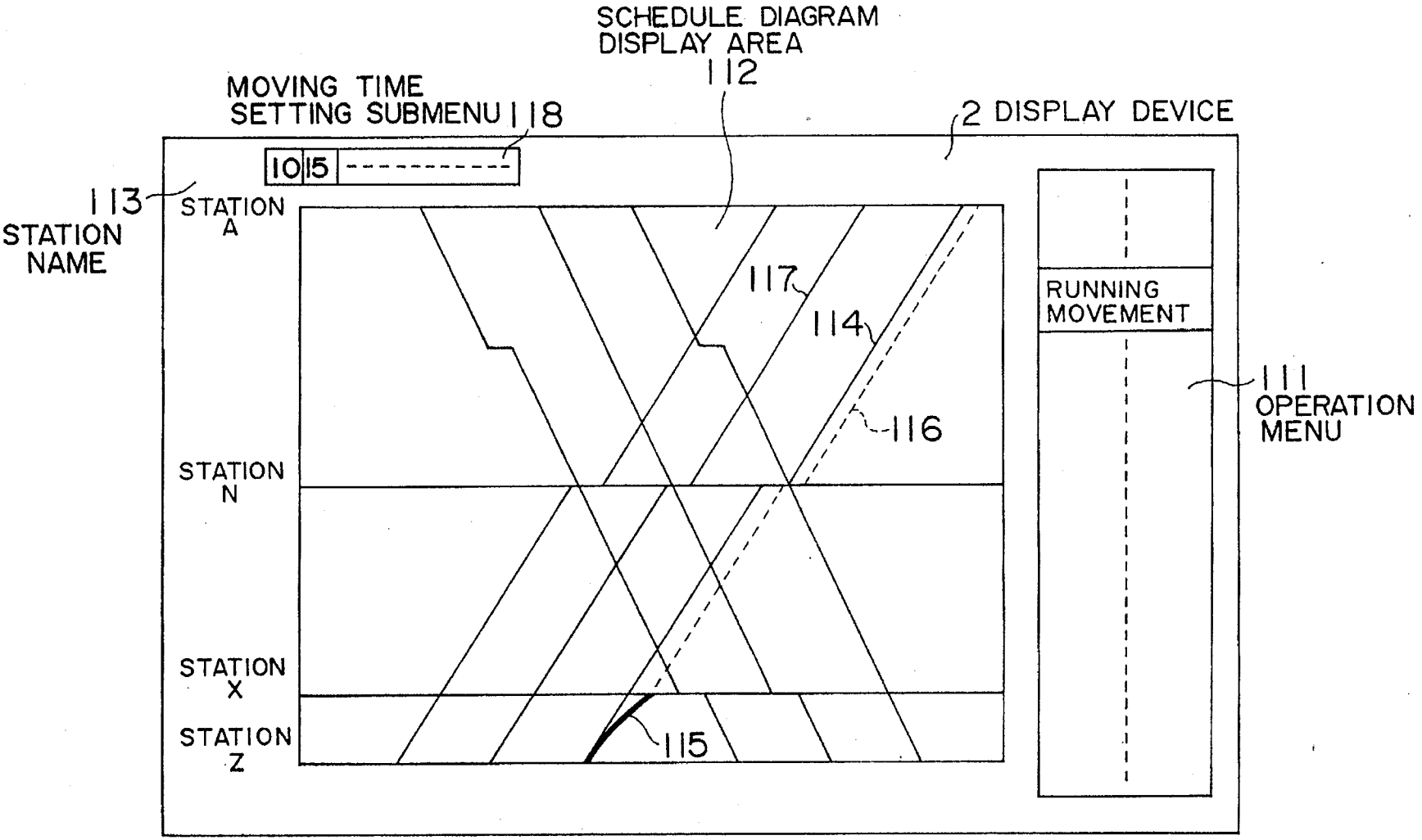
FIGS. 11, 12 and 13 show examples of screen according to the present invention.

FIG. 11 shows an example of screen of the display device 2. Numeral 111 denotes an operation menu whereby an operator gives instructions at the time of schedule diagram generation, 112 an area for displaying a running train trajectory string-line, and 113 a station name. Numerals 114 and 117 denote train running schedules (hereafter referred to as plan lines) displayed on the basis of the train schedule data stored in the train schedule database 21 (FIG. 2). A thick solid line 115 indicates an actual running train trajectory string-line displayed on the basis of actual train running results stored in the actual train tracking database 22 (FIG. 2). A broken line 116 denotes train running prediction (hereafter referred to as prediction line) predicted on the basis of the actual running train trajectory string-line. Numeral 118 denotes moving time setting submenu for setting the moving time when moving the train running plan line back and forth.

Figure 12:
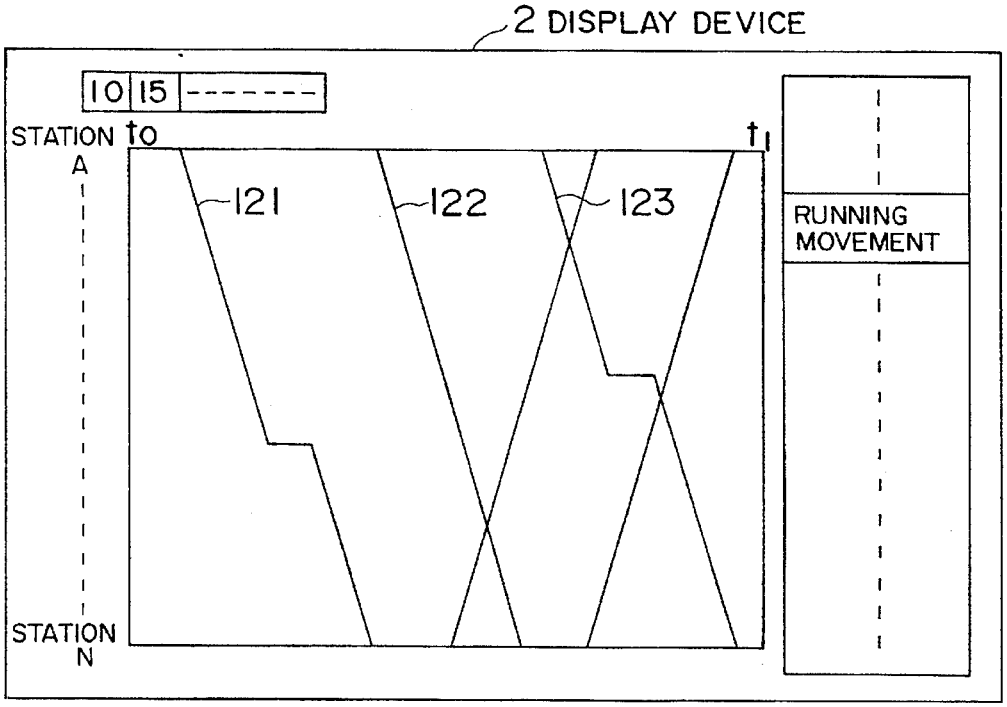

FIG. 12 shows an example of the screen of the display device 2 when planning responsibility is divided. Numerals 121 to 123 denote train plan lines.

Figure 13:
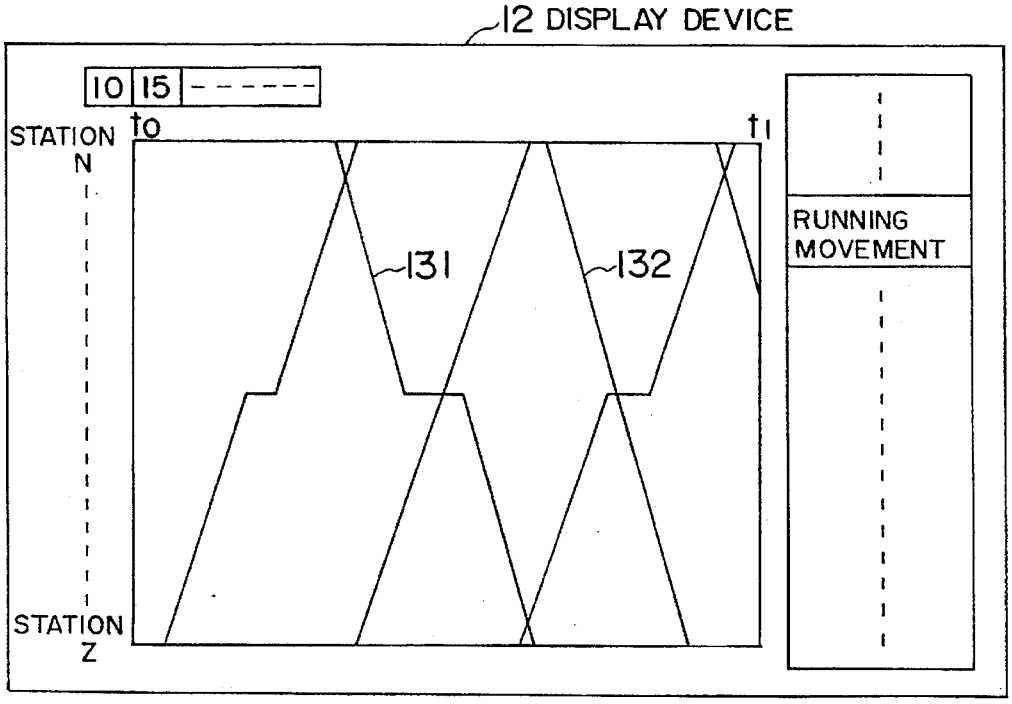

FIG. 13 shows an example of the screen of the display device 12 when planning responsibility is divided. Numerals 131 and 132 denote train plan lines.

Figure 14:
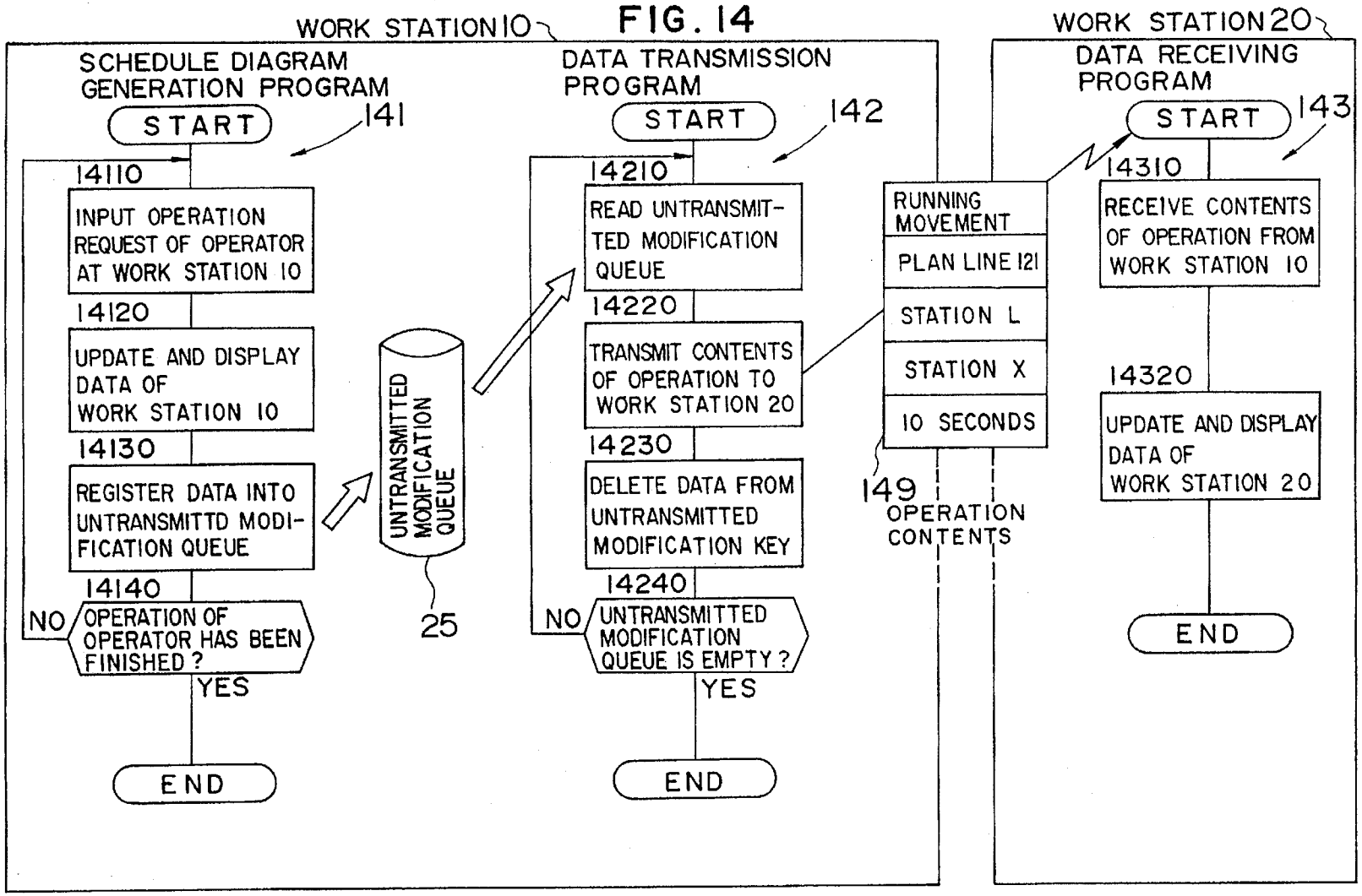
FIGS. 14 and 15 are processing flow charts of competition management according to the present invention.

FIG. 14 is a flow chart showing the processing performed when an operator conducts operation at the work station 10 having priority status. Numeral 141 denotes a flow chart showing the processing of a train schedule database update program performed when an operator conducts operation at the work station 10. Numeral 142 denotes a processing flow chart of a program for transmitting contents of operation from the work station 10 to the work station 20. Numeral 143 denotes a processing flow chart of a program for receiving data from the work station 10 and reflecting the received contents onto the schedule diagram at the work station 20. Numeral 149 denotes an example of contents read from the untransmitted update request queuing area and transmitted to the work station 20.

Figure 15:
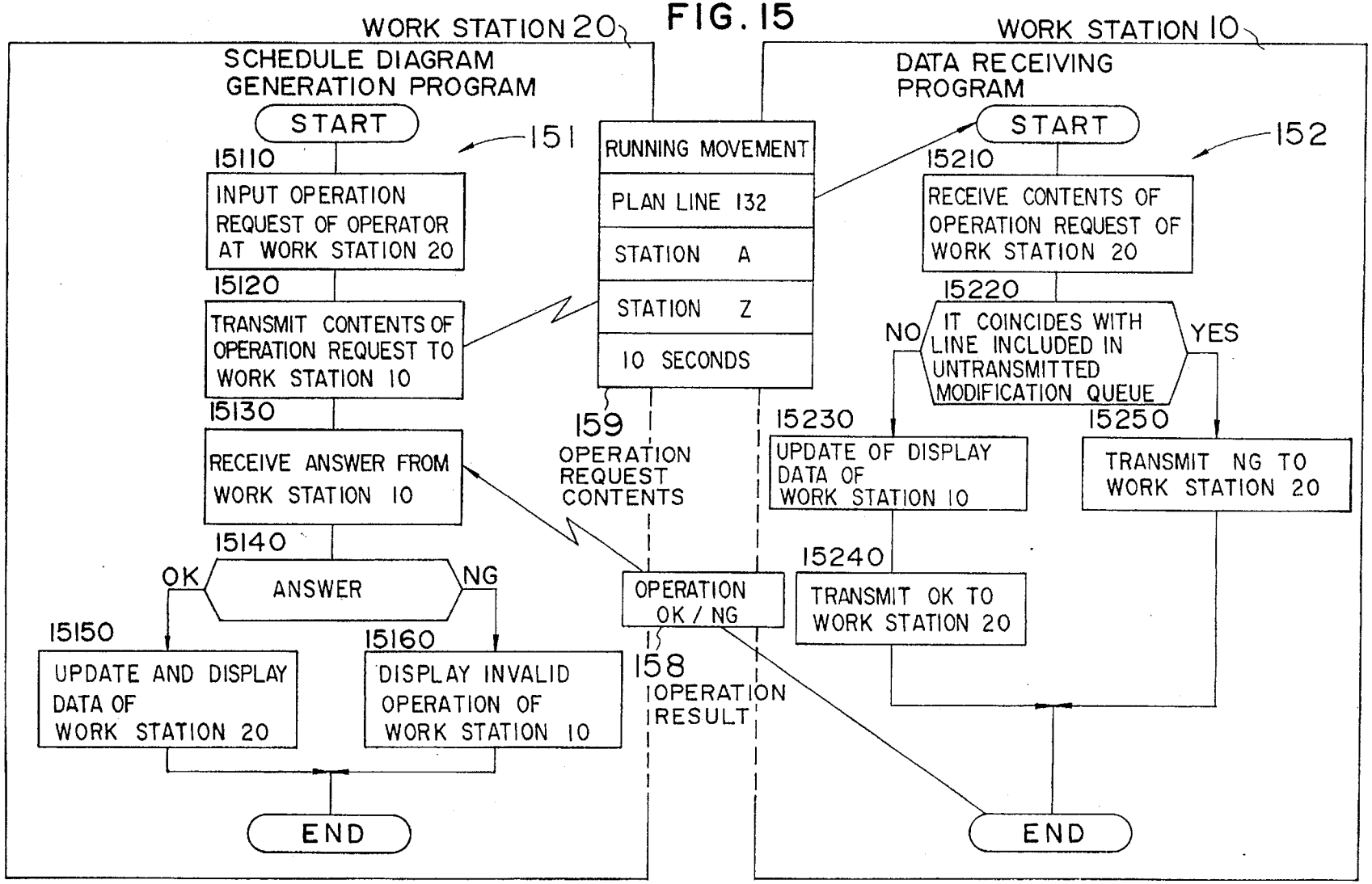

FIG. 15 is a flow chart showing the processing performed when an operator conducts operation at the work station 20 having no priority. Numeral 151 denotes a processing flow chart of a train schedule database update program performed when an operator has conducted operation at the work station 20. Numeral 152 denotes a processing flow chart of a program for receiving data from the work station 20 and reflecting the received contents onto the database at the work station 10. Numeral 159 denotes an example of contents of an operation request issued from the work station 20 to the work station 10.

Assuming now that the work station 10 has priority over the work station 20, operation of the cooperation scheme using a plurality of work stations according to the present invention will hereafter be described.

First of all, in the normal state, operators monitor whether trains run as planned or not by using the work stations 10 and 20. If the actual running train string-line 115 is 20 seconds behind the plan line 114 at a station X in FIG. 11, for example, the prediction line 116 becomes 20 seconds behind the plan line 114. Therefore, the space with respect to the preceding plan line 117 is prolonged. Each string-line represents a running train. If the spacing between string-lines becomes long, therefore, passengers waiting for a train at the station increase. As a result, crowdedness occurs in the train, and the time required for getting on and off is prolonged, the train being further delayed. In order to prevent this, the operator alters the plan beforehand, so that spaces between lines may become equivalent as far as possible. By keeping the train represented by the schedule string-line 117 waiting at station N for ten seconds, for example, the space between the running train schedule string-line 117 and the prediction line 116 becomes equal to the space between the running train schedule string-line 117 and a train immediately preceding it. This operation for keeping the train represented by the schedule string-line 117 waiting at the station N for ten seconds is conducted in accordance with the following procedure.

(1) Pick "departure time update" in the operation menu 111 with the mouse 4.

(2) Pick the section wherein the line is to be delayed with the mouse 4. In case the line is to be delayed in the section between the stations N and A, for example, pick the stations N and A with the mouse 4.

(3) Pick the line to be delayed, i.e., the running train schedule string-line 117 with the mouse 4.

(4) Pick 10 (meaning 10 seconds) in the departure time update submenu 118 as the moving time with the mouse 4. If a right button of the mouse 4 is pressed at this time, right movement (i.e., delay request) is performed. If a left button is picked, left movement (i.e., advanced departure request) is performed. As a result of the operation (1) to (4) described above, running information of the train represented by schedule string-line 117, i.e., the station departure time and the station arrival time ranging from the station N to the station A, are updated. The updated result is displayed again.

As heretofore described, the operator monitors whether the train is run as planned and alters the plan. In case a large number of lines are subject to plan alteration or a large section is subject to plan alteration, plan alteration is performed from both the work stations 10 and 20. At this time, it becomes necessary to perform operation conflict management to alter the plan of the same train schedule database from a plurality of work stations. It is now assumed that the work stations 10 and 20 respectively take charge of stations A to N and stations N to Z shown in FIG. 11. FIGS. 12 and 13 show examples of the screen obtained when planning responsibilities are divided. As for the contents of the divided planning responsibilities database 24 (FIG. 4) of the work station 10 at this time, the beginning of the allotted time range 41 is the screen display start time $t_0$ and the end of the allotted time range 42 is the screen display last time $t_1$ whereas the beginning of the allotted station range 43 is the station A and the end of the allotted station range 44 is the station N. Contents of the divided planning responsibilities database 34 of the work station 20 become $t_1$, station N and station Z, respectively. It is now assumed that the running train trajectory string-line 121 of FIG. 12 and the plan line 131 of FIG. 13 are the same lines as the plan line 122 of FIG. 12 and the plan line 132 of FIG. 13 connected at the station N, respectively. First of all, the procedure of operation conflict management in case the operator conducts operation at the work station 10 such as the case where the running train trajectory string-line 121 is moved to the right by ten seconds in FIG. 12 will now be described along the flow of FIG. 14.

If the operator requests operation, the program 141 operates in accordance with the following procedure.

(1) At step 14110, operation request of the operator at the work station 10 is inputted from the mouse 4. Details of operation contents are similar to those in "departure time update" described before. First of all, the "departure time update" menu is picked with the mouse 4. Thereafter, station names in the movement range, i.e., stations A and Z as well as the plan line are picked with the mouse 4. Movement time of ten seconds is picked by the right button of the mouse.

(2) Since the work station 10 has priority, its operation is executed unconditionally at step 14120. That is to say, moving the plan lines 121 and 131 is registered in the alteration time of station arrival 105 (FIG. 10) and the alteration time of station departure 106 (FIG. 10) of the train reschedule database 23 (FIG. 2) of the work station 10. In FIG. 12, the running train trajectory string-line 121 moves to the right by 10 seconds.

(3) At step 14130, the contents of operation of moving the running train trajectory string-line 121 to the right by 10 seconds are put into the untransmitted update request queuing area 25 (FIG. 2) for transmission to the work station 20. As for the contents of the untransmitted update request queuing area 25 at this time, "departure time update" is set into the operation division 51 of FIG. 5 and "running train trajectory string-line 121" is set into the train running information 52 whereas movement section "station A" and "section Z" as well as movement time "10 seconds" are set into the data 53. Since the untransmitted update request queuing area 25 is a first-in first-out table, contents thus set are registered into the rear end of the untransmitted update request queuing area 25.

(4) The above described operation (1) to (3) is repeated until the operator completes the processing.

With reference to FIG. 14, the program 142 always monitors whether data is present in the untransmitted update request queuing area 25 or not. In case data is present, operation is conducted in accordance with the following procedure.

(1) At step 14210, contents of operation at the work station 10 are read from the top of the untransmitted update request queuing area 25.

(2) At step 14220, the contents 149 of operation (FIG. 14) thus read are transmitted to the work station 20.

(3) Since the untransmitted update request queuing area 25 is a first-in first-out table, contents of the untransmitted update request queuing area 25 read at the step 14210 are deleted at step 14230.

(4) The above described operation (1) to (3) is repeated until the untransmitted update request queuing area 25 becomes empty.

If contents of operation are transmitted from the work station 10, the program 143 functions at the work station 20 in accordance with the following procedure.

(1) At step 14310, the contents of operation 149 transmitted from the work station 10 are received.

(2) Since the work station 20 has no priority, results of this operation are reflected unconditionally onto the work station 20. That is to say, moving the running train trajectory string-line 121 (i.e., the plan line 131) is registered into the alteration time of station arrival 105 (FIG. 10) and the alteration time of station departure 106 (FIG. 10) of the train reschedule database 33 (FIG. 3) of the work station 20. In FIG. 13, the plan line 131 moves to the right by 10 seconds.

The procedure of operation conflict management in case the operator conducts operation at the work station 20 having no priority such as the case where the plan line 132 is moved to the left by ten seconds in FIG. 13 will now be described along the flow of FIG. 15. The operation conflict management means that a conflict of operation is prevented wherein two work stations are simultaneously operated for the same line.

First of all, the program 151 functions in the work station 20 in accordance with the following procedure.

(1) At step 15110, contents of operation request of the operator at the work station 20 are inputted from the mouse 14. Details of operation contents are similar to those of "departure time update" described above. First of all, "departure time update" menu is picked with the mouse 4. Thereafter, station names of the movement range, i.e., stations A and Z as well as the plan line are picked with the mouse 4. Movement time of 10 seconds is picked by the left button of the mouse.

(2) At step 15120, contents of operation request 159 at the work station 20 are transmitted to the work station 10.

(3) At step 15130, answer from the work station 10 is received.

(4) Upon receiving operation OK, the updated station arrival time 105 (FIG. 10) and the updated station departure time 106 (FIG. 10) of the predicted schedule diagram table 33 (FIG. 3) are updated at step 15150, and the plan line on the screen is moved.

(5) Upon receiving operation NG, the request of the operation is rejected in the work station 10, then, the invalid operation message is displayed to report on the operation at step 15160.

Upon receiving the operation request from the work station 20, the program 152 functions in the work station 10 in accordance with the following procedure.

(1) At step 15210, the contents of the operation request 159 from the work station 20 are received.

(2) At step 15220, it is checked whether or not the line stored in the content of operation request 159 (that is, the plan line 132) coincides with the line stored in the content of operation (this is already executed in the work station 10, but not transmitted to the work station 20 yet) in the untransmitted update request queuing area of the work station 10 (i.e., whether there is untransmitted operation for the work station 20 stored in the untransmitted update request queuing area 25 and relating to the plan line 132, that is plan line 122 (FIG. 12) or not). It is noted that the plan line 132 in the work station 20 is equal to the plan line 122 in the work station 10.

(3) In case of noncoincidence at step 15220, the operation request at the work station 20 is made valid to update the train reschedule database 23 (FIG. 2) and more and display the plan line 122 (FIG. 12) at step 15230. At step 15240, the operation request at the work station 20 is made valid and the operation result 158 of operation OK is transmitted to the work station 20 as answer.

(4) In case of coincidence at step 15220, the operation request at the work station 20 is made invalid and the operation NG is returned as answer at step 15250. Data is not updated.

In the present embodiment, there is little overhead in case the work station 10 is used. In case of the work station 20 as well, only search of the untransmitted update request queuing area 25 is involved with the exception of communication overhead, resulting in an effect of small overhead.

Further, the allotted time can be easily changed only by changing the contents of the divided planning responsibilities 24 and 34 when responsibilities are divided, for example, by changing the beginning of the allotted time range 41 in FIG. 4.

Therefore, flexible responsibility division of a plan according to the state of the plan and the number of operators becomes possible.

Further, by mutually monitoring the answer time among work stations and automatically expanding the allotted time to the whole in case there is no answer for a predetermined time or longer, backup becomes possible.

As a result, the reliability of the whole system can be made high.

The present embodiment has been described with reference to the case of train schedule database generation. As a matter of fact, however, the present embodiment can be easily applied to other fields. In case scheduling of nurse arrangement is performed in a hospital, for example, nurses can take partial change of work stations according to on-duty hours if the number of nurses is large.

The present invention brings about the following effects.

(1) Operation conflict management for a plurality of work stations is facilitated.

(2) Overhead at the time of operation is small.

(3) Since operation at a work station having priority takes precedence, occurrence conflict in opinion among a plurality of operators is prevented.

(4) Even if a plan has a large scale, it is possible to make the plan without being restricted by the size of the display device.

(5) Since a plurality of work stations back up each other, the reliability of the system can be improved.

In the present embodiment, the work station 10 shown in FIG. 14 has the untransmitted update request queuing area 25. By transmitting the contents of the untransmitted update request queuing area 25 to the work station 20 as the contents 149 of operation, the work station 10 takes precedence in processing over the work station 20. On the contrary, however, the work station 20 may have the untransmitted update request queuing area 25 and its contents may be transmitted to the work station 10 as the operation request contents 159. In this case, the work station 20 has priority.

Further, both work stations 10 and 20 may have untransmitted modification queues. In this case, contents of both untransmitted modification queues can be mutually transmitted by providing the work station 20 with the same program as the data transmission program 142 shown in FIG. 14.

Further, in the present embodiment, two work stations 10 and 20 comprising storage devices 5 and 15 as well as central processing units 1 and 11 are used. Even in a typical system comprising one computer and two terminal devices, however, the present invention can be easily implemented.

What is claimed is:

1. An information processing system for maintaining consistency of database copies at a plurality of database operation sites that are connected to one another, said information processing system comprising:

said plurality of database operation sites, each having at least a computer and a storage device to store said database copies, wherein one of said database operation sites is designated a prioritized operation site, which has an untransmitted update request queuing area in said storage device, said prioritized operation site having an original database and each site having a database copy of the original database, wherein further said computer in said prioritized operation site (i) stores, in said untransmitted update request queuing area, at least one non duplicate update request input and/or sent from operation sites other than said prioritized operation site, (ii) according to said update request, updates the original database only if the update request currently being processed does not conflict with or contradict other requests stored in the untransmitted update request queuing area (iii) transmits the result of said requests to the operation sites other than said prioritized operation site, wherein the result is received in each of the operation sites other than said prioritized operation site and each of said database copies therein is updated without utilizing exclusive control data which includes a semaphore, and (iv) deletes said requests from said untransmitted update request queuing area, thus serving only one update request at a time without missing succeeding update requests;

an input device;

a display device;

generating means for generating a database; and updating means for updating the database.

2. An information processing system for scheduling and rescheduling, according to claim 1, for use in train scheduling and rescheduling, said information processing system further comprising:

an allotted operation range control data block for allotting ranges of the operation of each database operation site, wherein said input device inputs each of said allotted ranges, and wherein said display device in each database operation site displays said train time-table within the ranges specified in each of said operation function allotted range control data blocks, said input device inputs an updated scheduling database and said rescheduling database from said updating means according to said displayed allotted ranges and actual performance of each of operational functions within said ranges allotted for each database operation site.

3. An information processing system according to claim 1, wherein each of said plurality of database operation sites comprises:

at least a central processing unit;

input devices;

a display device; and a storage device for storing said database copies, wherein said storage device at said prioritized operation site has an original database for scheduling and rescheduling and also has a queuing area for storing said untransmitted update requests for maintaining consistency of said scheduling and rescheduling databases among all of said database operation sites.

4. An information processing system according to claim 3, wherein said prioritized operation site further comprises a server comprising a mainframe class computer or a datacenter class computer, wherein, said storage device for said prioritized operation site includes said queuing area for storing said update requests, and wherein other of said database operation sites comprise a personal computer.

5. An information processing system, according to claim 2, for train scheduling and rescheduling, wherein said allocated range of operational functions include operational time range and operational stations.

6. An information processing system according to claim 3, for moving object operation scheduling and rescheduling, wherein said database copies stored at said database operation sites comprise a moving object scheduling database, an actual moving object tracking database and a moving object rescheduling database.

7. An information processing system according to claim 6 wherein said database copies stored at said database operation sites comprise a train schedule database, an actual running train tracking database and a train rescheduling database.

8. An information processing system according to claim 4, for moving object operation scheduling and rescheduling, wherein said database copies stored in said storage devices comprise a moving object schedule database, an actual moving object tracking database and a moving object rescheduling database.

9. An information processing system according to claim 10, for train scheduling and rescheduling, wherein said database copies stored at said database operation sites comprise a train schedule database, an actual running train tracking database and a train rescheduling database.

10. An information processing method for maintaining consistency of database copies in a processing system comprising a plurality of database operation sites that are connected to one another, one of said plurality of database operation sites having been designated a prioritized operation site having an untransmitted update request queuing area for storing database update requests until a database update is confirmed in every other one of said plurality of database operation sites, said information processing method comprising the steps of:

inputting non duplicate database update requests at any of said database operation sites;

transmitting database update requests, input at database operation sites other than said prioritized operation site, to said prioritized operation site;

rejecting and deleting the update request when a contradicting request for updating the same data already exists in said untransmitted update request queuing area at said prioritized operation site;

saving the non contradicting database update requests, in said update request queuing area at said prioritized operation site, as an untransmitted modification queue;

changing said database of said prioritized operation site according to said database update requests;

transmitting each one of said database update requests to every one of said plurality of database operation sites from said prioritized operation site;

deleting individual database update requests as each of said individual database update requests is transmitted to, and the respective database update is executed in, every one of said plurality of database operation sites other than said prioritized operation site, thus serving only one update request at a time without missing succeeding update requests and without utilizing exclusive control data which includes a semaphore.

11. An information processing method according to claim 10 for use in scheduling and rescheduling, said database copies comprising copies of a scheduling database and a rescheduling database.

12. An information processing method, according to claim 11, for moving object scheduling and rescheduling wherein said database copies stored in said storage device comprises moving objects scheduling database copies, actual moving objects tracking database copies and moving objects rescheduling database copies, wherein said moving object scheduling database is revised according to update requests received at any of said database operation sites, said update requests being input at said prioritized operation site until said update request is transmitted to all of said database operation sites.

13. An information processing method according to claim 12, further comprising the steps of:

storing database update results in said rescheduling database, and displaying actual and predicted progress of said moving objects, accordingly.

14. An information processing method according to claim 12, for train scheduling and rescheduling, wherein said database copies stored in said storage device of said database operation sites comprise train scheduling database copies, actual train tracking database copies and train rescheduling database copies, wherein said train scheduling database is revised according to update requests received at any of said database operation sites, said update requests being stored at said untransmitted update requests queuing area in said prioritized operation site until said update requests are transmitted to all of said database operation sites.

15. An information processing method according to claim 13, for train scheduling and rescheduling further comprising the steps of:

storing database update result in said rescheduling database, and predicting and displaying progress of trains, accordingly., and actual and predicted said progress of trains is displayed as train string-line diagram.

16. An information processing method according to claim 11, wherein for scheduling, database copies stored in said storage device at said database operation sites comprise scheduling and rescheduling database copies, wherein said scheduling database copies at any of said database operation sites are revised according to update requests inputted at any of said database operation sites, said untransmitted update requests being stored at said prioritized operation site until said update request is transmitted to all of said database operation sites except for said prioritzed operation site.

17. An information processing method according to claim 16, for scheduling, further comprising the steps of:

storing database update result in another database such as said rescheduling database, and displaying said result as a diagram, said database update result being displayed as a train string-line diagram for train scheduling.

18. An information processing method according to any of claims 11–17, further comprising the steps of:

storing an operation range alloted to each one of database operation sites;

displaying said allotted ranges of said scheduling and rescheduling database copies as diagram;

consistently updating said scheduling data and rescheduling database copies according to the operation of said range of said database copies displayed as diagram and said database update request queues stored at said prioritized operation site.

19. An information processing method for scheduling and rescheduling according to claim 18, wherein said range can be changed.

20. An information processing system for use in scheduling and rescheduling and for maintaining consistency of database copies at a plurality of database operation sites that are connected to one another, said information processing system comprising:

said plurality of database operation sites, each having at least a computer and a storage device to store said database copies, wherein one of said database operation site is designated a prioritized operation site, said prioritized operation site having an original scheduling database and rescheduling database and each site other than said prioritized operation site having a database copy of said original scheduling database and rescheduling database, said prioritized operation site further having an untransmitted update request queuing area in said storage device, wherein said computer in said prioritized operation site stores, in said queuing area, the untransmitted non duplicate update request input and sent from operation sites other than said prioritized operation site, if no contradicting request for updating the same data exists in said queuing area, until said untransmitted update request is executed to update said scheduling and rescheduling databases in said prioritized operation site and said request is sent back to the operation sites other than said prioritized operation site to update the copy of said scheduling and rescheduling databases therein without utilizing exclusive control data which includes a semaphore;

and input device;

a display device;

generating means for generating a schedule; and rescheduling means for generating a revised schedule.

* * * * *